US010755531B1

(12) United States Patent
Buten

(10) Patent No.: US 10,755,531 B1
(45) Date of Patent: Aug. 25, 2020

(54) CASINO STYLE GAME

(71) Applicant: Flushed Game, LLC, Cincinnati, OH (US)

(72) Inventor: David R. Buten, Cincinnati, OH (US)

(73) Assignee: Flushed Game, LLC, Cincinnati, OH (US)

( * ) Notice: Subject to any disclaimer, the term of this patent is extended or adjusted under 35 U.S.C. 154(b) by 0 days.

(21) Appl. No.: 16/434,246

(22) Filed: Jun. 7, 2019

(51) Int. Cl.

| | |
|---|---|
| ***A63F 1/00*** | (2006.01) |
| ***G07F 17/32*** | (2006.01) |
| *A63F 3/00* | (2006.01) |
| *A63F 11/00* | (2006.01) |

(52) U.S. Cl.
CPC ..... *G07F 17/3293* (2013.01); *G07F 17/3204* (2013.01); *G07F 17/3288* (2013.01); *A63F 1/00* (2013.01); *A63F 3/00157* (2013.01); *A63F 2001/003* (2013.01); *A63F 2003/0017* (2013.01); *A63F 2003/00167* (2013.01); *A63F 2011/0086* (2013.01)

(58) Field of Classification Search
CPC .. A63F 1/00; A63F 3/00157; A63F 2001/003; A63F 2003/00164; A63F 2003/00167; A63F 2003/0017; A63F 2011/0086
USPC ..... 273/292, 274, 309
See application file for complete search history.

(56) References Cited

U.S. PATENT DOCUMENTS

| | | | | |
|---|---|---|---|---|
| 5,398,938 A * | 3/1995 | Money | A63F 1/04 | 273/239 |
| 5,938,200 A * | 8/1999 | Markowicz | A63F 3/081 | 273/138.2 |
| 6,079,713 A * | 6/2000 | Paz | A63F 1/00 | 273/292 |
| 6,550,772 B1 * | 4/2003 | Streeks | A63F 3/00157 | 273/274 |
| 9,539,499 B2 * | 1/2017 | Brown | A63F 3/00006 | |
| 2003/0062677 A1 * | 4/2003 | Streeks | A63F 3/00082 | 273/274 |

* cited by examiner

*Primary Examiner* — Benjamin Layno
(74) *Attorney, Agent, or Firm* — Wood Herron & Evans LLP

(57) ABSTRACT

Provided is a casino-style game for one or more players. A standard, shuffled four-suited deck of playing cards is provided, along with at least one wager-indicating marker is for each player. A playing field having indicia indicating designated areas is provided. The designated areas including integer spaces designated for the integers five through seventeen on which at least one wager-indicating marker is placed by a player. To determine an integer between five and seventeen, the cards are dealt sequentially until five cards of one suit have been dealt. The determined integer is the total numbers of cards dealt. Any bet made on the determined integer is paid according to predetermined odds.

7 Claims, 4 Drawing Sheets

CASINO STYLE GAME

TECHNICAL FIELD

This invention relates to a game and playing method for one or more players that may be played as a casino-style game on a table with wagering or may be played as a home board-type game. More particularly, the game uses a playing field on a board or table, in combination with a deck of ordinary playing cards.

BACKGROUND

Casino patrons like to play games with rules that be understood quickly and that offer flexibility of wager size, odds, and payout. Games with complex betting rules may be intimidating to novices, which discourages some from participating. While some patrons are attracted to games that involve some element of skill and strategy (such as poker or blackjack), others are attracted to games that are purely chance (like roulette or slot machines).

Games that allow multiple players to bet at the same time (like roulette, craps, or blackjack) can foster social interaction and camaraderie, which encourage the players to continue playing. Games that do not play out instantly, but that develop over a relatively short period of time (typically less than two minutes), like a horse race, allow players to cheer for a favorable outcome, extending the excitement of the wagering experience.

SUMMARY OF THE INVENTION

The present invention provides a casino-style game with simple rules with the winner(s) determined purely by chance. It uses a deck of ordinary playing cards, with which most casino patrons are already familiar, to determine a number between five and seventeen and allows the player to choose from a wide variety of betting odds and payouts. The game can be played with a single player or multiple players. Each player can make multiple bets and can choose different bets with different probability of winning and payout odds. The game develops as cards are dealt, with different potential winners being "close" or "in the lead," but the final outcome not determined until the final card is dealt.

In general, after bets have been made, play begins by dealing an ordinary shuffled deck of playing cards, revealing one at a time, until the fifth card of one suit has been dealt. The total number of cards dealt is necessarily between five and seventeen, but the probability of each number varies widely. Each round, players can make "inside" or "straight" bets on what will be the total number of cards dealt. The odds (and payout) for each number are different, with five being the longest odds, but delivering the largest payout.

"Outside" bets can be made, for example, as to the suit or color of the final card, or on other combinations or groups. In some embodiments, a number may be the "house" number, causing all outside bets to lose, although players also can bet on the house number.

In a casino setting the game would have a dealer who does not make bets, but who deals the cards and pays out on winning bets. In a home version, the dealer could also be a player and make bets. Additionally, the role of dealer could rotate among the players.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION

Figure 1:
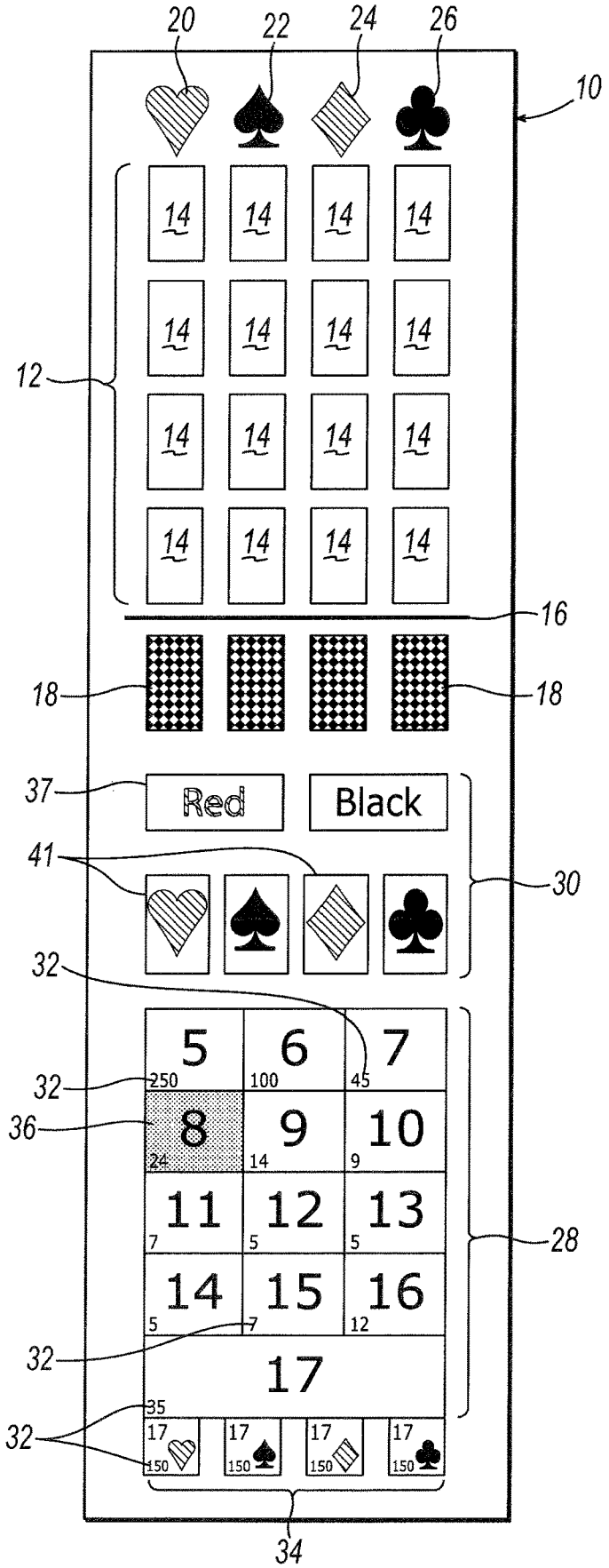
FIG. 1 is a representation of the playing surface of the game according to a first embodiment of the invention.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

Casino patrons can be assumed to have familiarity with a standard deck of playing cards, consisting of 52 total cards, 13 each of four suits (hearts, spades, diamond, clubs). They can also be assumed to be familiar with number-picking games, like roulette.

Referring first to FIG. 1, therein is shown the playing area or field 10 with indicia according to a first embodiment of the invention. The playing field 10 may be on a game board for a home-play version or may be printed, for example, on the surface of a table for a casino-style version. The playing field 10 includes a grid 12 having four columns and four rows of designated spaces 14 for placement of playing cards as they are dealt. At the bottom of the grid 12 may be a finish line 16 or other demarcation separating the grid 12 from a final space 18 below each column. Indicia 20, 22, 24, 26 is provided at the top of each column, for example, indicating the suit (i.e., hearts, spades, diamonds, or clubs) of the column. Instead of or in addition to the finish line, the final spaces 18 may include indicia or other demarcation indicating their special status.

Elsewhere on the playing field 10 is a betting field 28 wherein spaces are labeled with the numerals 5 through 17. Players may place bets on the betting field 28, such as with casino chips. Another portion of the playing field 10, shown at 30, may include areas for "outside" bets. These may include, for example RED/BLACK or a particular suit (hearts, spades, diamonds, or clubs).

In general, a winning number represented in the betting field 28 is determined by dealing a randomly shuffled deck of ordinary playing cards onto the grid one at a time. As each card is dealt, it is placed in the column representative of its suit 20, 22, 24, 26. When a fifth card of one suit is dealt, it is placed on the final space 18 corresponding to its suit. Once a fifth card of one suit has been dealt, the deal ends. The total number of cards dealt (integers starting with the minimum of five and the maximum of seventeen) determines the winning number in the betting field 28. The suit and/or color of the final card may determine the winner(s) of any outside bets 30.

The integer (number) determined by each deal is not predictable, but is "probabilistic" rather than strictly "random," so the odds for each integer determined (and the corresponding number spaces in the betting field 28) are different. Thus, the payout for a bet on any particular number may also vary accordingly. The least common number to be selected is five, resulting only when the first five cards dealt from a shuffled deck are all of the same suit. The most common numbers to be selected are 12, 13, and 14. Seventeen is only selected after four cards of each suit have been dealt first. The payout ratio for each number in the betting field 28, determined by the corresponding odds of that number being selected, may be indicated by indicia 32 shown in the block associated with each number. The payout for outside bets 30, which are simpler and more intuitive, may or may not be indicated on the playing field 10. Details of the odds and payout ratios will be explained separately, below.

If desired, additional spaces 34 for enhanced bets may be provided to add variety and increase the potential payout. For example, in the FIG. 1 embodiment, enhanced bet spaces 34 are shown associated only with the number seventeen. Each of the enhanced bets 34 also includes a symbol representative of each of the four suits (hearts, spades, diamonds, and clubs). This allows a player to bet not only on the number seventeen (of any suit) but to also guess which suit will be associated with the final, seventeenth card dealt. In this example, the payout for seventeen is 35 to 1, while the enhanced payout for also correctly choosing the suit of the final card increases to about 140-150 to 1.

If desired, one of the number blocks in the betting field 28 may be designated as a "house" number 36. In the illustrated embodiment, the house number is the betting space 36 for the number eight. In this example, if eight cards are dealt to reach the fifth of a given suit, only bets on the number eight block 36 in the betting field 28 will pay when the "house" number wins—all outside bets 30 lose. This option can add drama as the cards are dealt (and give the house a small, extra advantage). If one of the columns in the grid 12 has already been filled with four of a suit, the next card dealt could end the game. Players who have made outside bets 30 are cheering for a lower or higher number (than the house number 36) to win. In some cases, this will create extra anticipation as the eighth card is dealt. Players are free to bet on the house number block 36, and they will win if that number is selected. Typically, the house would choose a number with neither the highest or lowest odds.

Figure 3:
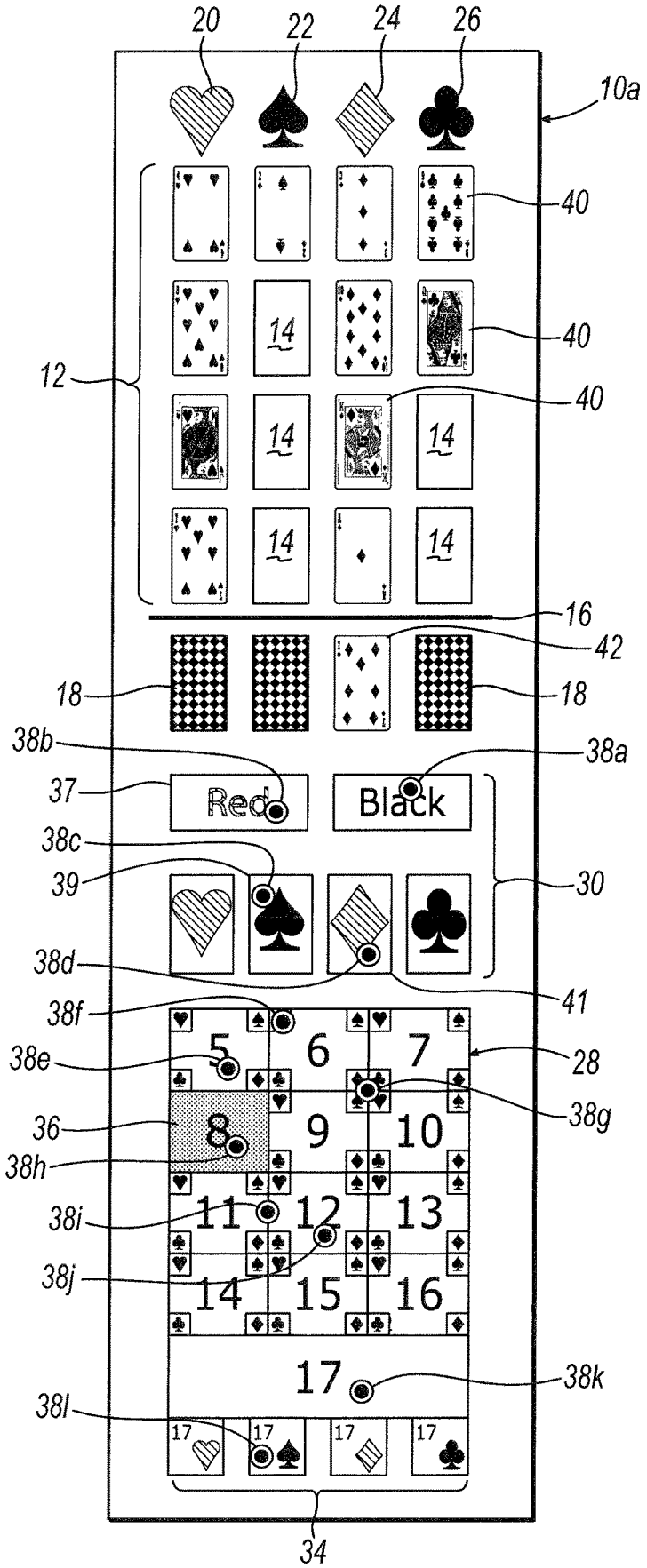
FIG. 3 shows the playing surface of FIG. 2 with an example card deal and example players' markers.

Referring now to FIG. 3, therein is shown the playing field 10*a* of the second embodiment with an example of game play being illustrated. Markers 38 have been placed by one or more players on numbered spaces within the betting field 28, outside betting spaces 30, and/or enhanced betting spaces 34. For simplicity of illustration, all markers 38 illustrated are identical in appearance. In practice, each player would have a different color or pattern of marker 38, which could also have a value denomination indicated on it. As in roulette and dice games (such as craps), a player may stack multiple chips or markers 38 on a betting space to increase the amount of the wager. More than one player may place a bet on the same number block of the betting field 28, outside bets 30, and/or enhanced bets 34. Each player can make as few or many bets as desired.

In the illustrated example, a marker 38*a* has been placed on BLACK, which will pay if the final card is either a spade or club. Another marker 38*b* has been placed on the RED space 37 in the outside betting field 30, which will pay if the final card is a heart or diamond. Likewise, markers 38*c*, 38*d* have been placed on the spade and diamond spaces 39, 41, respectively.

Within the main betting field 28, a marker 38*e* has been placed on the five square, which will pay in the event only five cards of a single suit are dealt. Another marker 38*f* represents an enhanced bet, paying only if six cards are dealt with the final card being a heart. Split bets are represented by other markers 38*g*, 38*i*. Split bets are allowed only within the main betting field 28 where number blocks share contiguous borders. A split bet will pay only one-half, one-third, or one-quarter of a straight bet. In this example, if the winning number is eight, none of the outside bets (as represented by markers 38*a*, 38*b*, 38*c*, 38*d*) will pay, but the player's straight up bet on eight (as represented by marker 38*h*) will pay. After all markers 38 have been placed by the players, the dealer indicates that board is closed to new wagers and existing wagers are final.

Turning now to the grid 12 onto which playing cards 40 are dealt, the dealer begins with a single, shuffled deck of ordinary playing cards. The cards are dealt and placed, one at a time, on spaces 14 associated with the corresponding suit 22, 24, 26, 28 of the card 40. In the illustrated example, four hearts, one spade, four diamonds, and two clubs were the first eleven cards to be dealt. The denomination of the card 40 is irrelevant in this game. The final card 42 was the fifth diamond to be dealt. In the illustrated example, after the first eleven cards 40 were dealt, only one more heart or diamond would end the game. While these two suits appeared to be "close" to a win, the odds favored the next card being a spade, because more spades remained in the deck than any other suit. After the first eleven cards 40 had been dealt, the numbers five through eleven (including "house" 36 number, eight) could not win. However, it remained possible that the final card to be dealt could be of either color (red/black) or of any suit. The final card 42 being dealt ended the game. The final card in this example was a diamond, so the marker 38*b* on RED and marker 38*d* on diamonds in the outside betting field 30 were winners. The straight up bet, represented by marker 38*j*, and the split bet, represented by marker 38*i*, were winners because the final card 42 was the twelfth card to be dealt, making bets on the number the twelve winners. After the final card has been dealt, the dealer clears the field 10, 10*a* of markers 38 and cards 40, resolves the payout for any winning bets, and opens the next game for new bets. A fresh and full shuffled deck of cards 40 is used for each game.

The winning number being determined by the deals of cards protracts the game to a modest degree (such as over roulette or craps) and gives it an evolving "tension" or a "horse race" feel, with players rooting for one suit over another, which changes as the deal progresses. Every card played changes the dynamic, which doesn't end until the last card is played. Some bets may be eliminated along the way, narrowing the possible outcomes. The outcome is based purely on chance, though the odds of winning vary with each of the selections made. The corresponding payout varies according to odds of winning. All players can "win" because no selection is excluded. In an alternate method of play, if the grid 12 of sixteen cards 40 have been dealt, leaving only seventeen as the possible winner, the dealer may allow wagers on seventeen to be adjusted partially or wholly to select a specific suit for a potential bonus payout.

Figure 4:
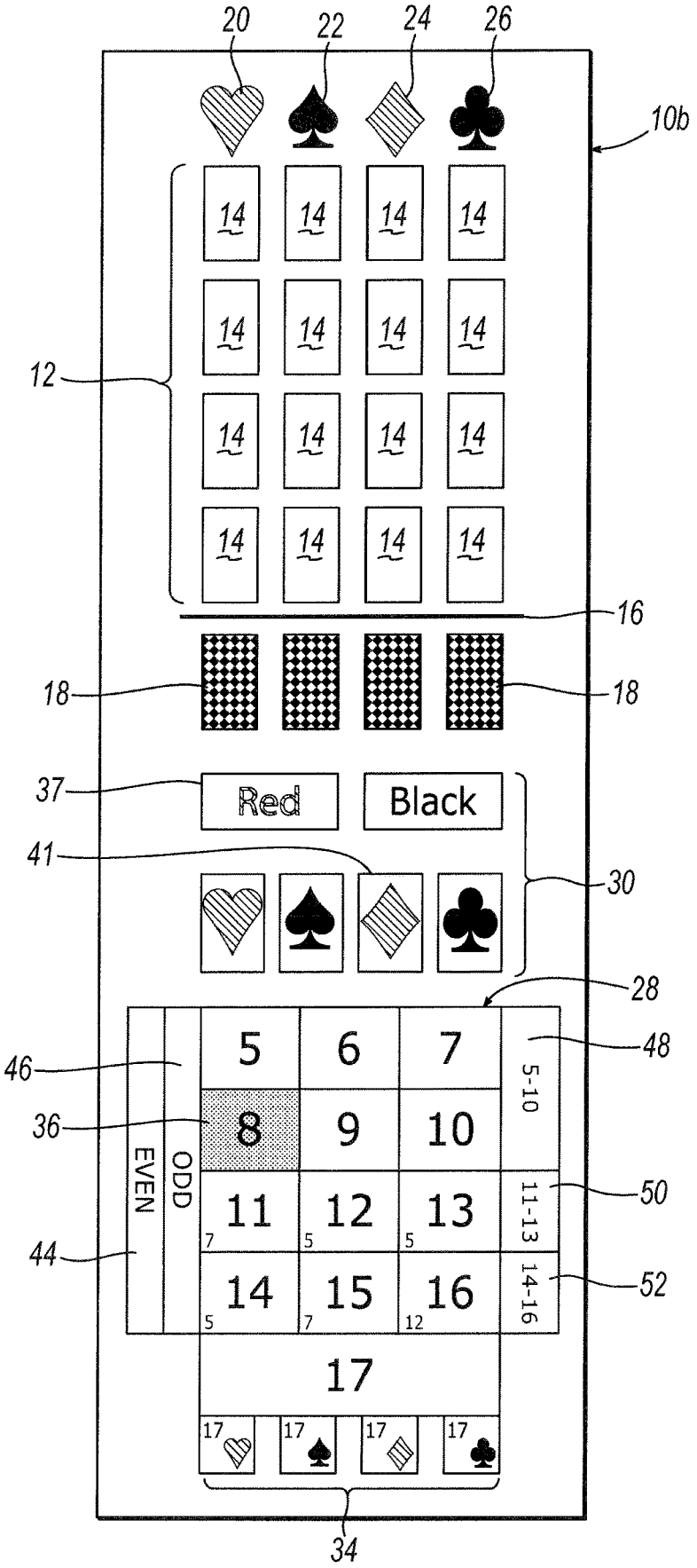
FIG. 4 is a representation of the playing surface of the game according to a third embodiment of the invention.

Referring now to FIG. 4, the illustrated playing field 10*b* of this embodiment includes additional "outside" betting spaces. A player may place a marker 38 in a space 44, 46 to indicate that the winning number will be EVEN or ODD, respectively. Alternatively, "outside" bets may be placed on the space 48 for group "5-10" (except "house" number 8) or on spaces 50, 52 representing the groups 11-13 and 14-16, respectively.

In casino gambling, the payout on bets having different odds are adjusted somewhat downward from the true payout ratio, to give the house an advantage. For example, the odds and payouts of American roulette (which includes both 0 and 00 as "house" numbers) are shown in Table 1, below. For example, on a single number bet that provides a 2.6% chance of winning, the true payout should be greater than 37 to 1, but the actual, adjusted payout given by the casino is 35 to 1.

TABLE 1

Odds & Payouts at American Roulette

| Roulette Bet | Odds (%) | True Payout | Adjusted Payout |
|---|---|---|---|
| Single Number | 2.6 | 37.462 | 35 to 1 |
| 2 Number Combination | 5.3 | 18.868 | 17 to 1 |
| 3 Number Combination | 7.9 | 12.658 | 11 to 1 |
| 4 Number Combination | 10.5 | 9.523 | 8 to 1 |
| 5 Number Combination | 13.2 | 7.576 | 6 to 1 |
| 6 Number Combination | 15.8 | 6.329 | 5 to 1 |
| Column | 31.6 | 3.165 | 2 to 1 |
| Dozen | 31.6 | 3.165 | 2 to 1 |
| Even/Odd | 47.4 | 2.109 | 1 to 1 |
| Red/Black | 47.4 | 2.109 | 1 to 1 |
| Low/High | 47.4 | 2.109 | 1 to 1 |

Figure 2:
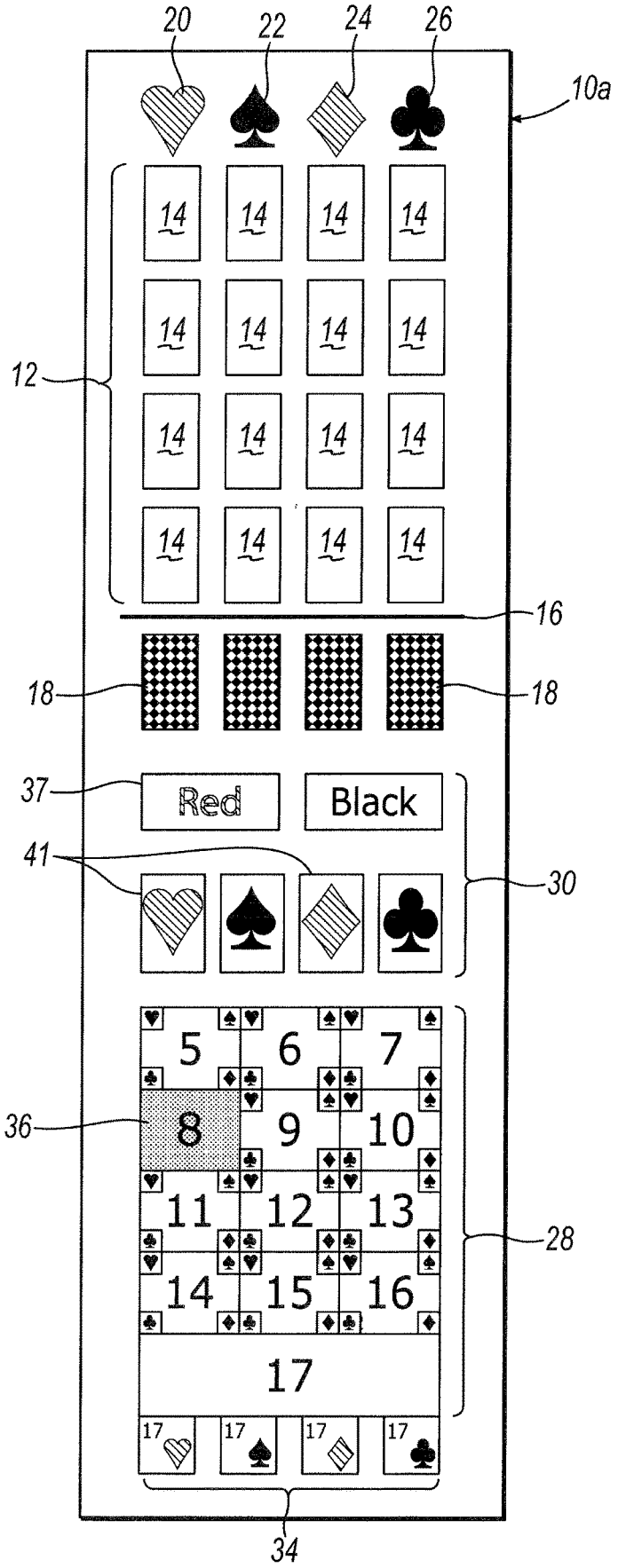
FIG. 2 is a representation of the playing surface of the game according to a second embodiment of the invention.

The odds, true payouts, and an example adjusted payout for each possible bet in the present game are shown in Table 2, below. For example, a bet on the number five has the lowest chance of winning (less than 0.2%). For such odds, the true payout would be more than 500 to 1. An adjusted payout of, for example, only 250 to 1 favors the house, but still provides the players the prospect of a very large win. According to the second embodiment (FIG. 2), a bet on the number 5, also choosing the correct suit, has even longer odds, but offers the prospect of an enormous payout. The odds for outside bets are adjusted in this example for a "house" number that forecloses all outside bets. These example payout odds are shown (at 32) in FIG. 1.

TABLE 2

Game Odds & Payouts

| Bet | Odds (%) | True Payout | Adjusted Payout |
|---|---|---|---|
| 5 | 0.198 | 504.8485 | 250 to 1 |
| 6 | 0.822 | 121.6814 | 100 to 1 |
| 7 | 2.037 | 49.0995 | 45 to 1 |
| 8 (House) | 3.907 | 25.5924 | 24 to 1 |
| 9 | 6.394 | 15.6398 | 14 to 1 |
| 10 | 9.305 | 10.7469 | 9 to 1 |
| 11 | 12.230 | 8.1764 | 7 to 1 |
| 12 | 14.537 | 6.8788 | 5 to 1 |
| 13 | 15.489 | 6.4563 | 5 to 1 |
| 14 | 14.451 | 6.9203 | 5 to 1 |

TABLE 2-continued

Game Odds & Payouts

| Bet | Odds (%) | True Payout | Adjusted Payout |
|---|---|---|---|
| 15 | 11.299 | 8.8503 | 7 to 1 |
| 16 | 6.809 | 14.6861 | 12 to 1 |
| 17 | 2.522 | 39.6524 | 35 to 1 |
| 17 + suit | 0.630 | 158.6096 | 140* to 1 |
| Odd (except 17) | 47.647 | 2.0988 | 1 to 1 |
| Even (except 8) | 45.924 | 2.1775 | 1 to 1 |
| 5-10 (except 8) | 18.756 | 5.3318 | 1 to 1 |
| 11-13 | 42.257 | 2.3665 | 3 to 2 |
| 14-16 | 32.559 | 3.0714 | 2 to 1 |
| 5 + Suit | 0.050 | 2019.394 | 1000 |
| 6 + Suit | 0.205 | 486.7257 | 400 |
| 7 + Suit | 0.509 | 196.3981 | 180 |
| 8 + Suit | 0.977 | 102.3697 | 96 |
| 9 + Suit | 1.598 | 62.5592 | 56 |
| 10 + Suit | 2.326 | 42.9874 | 36 |
| 11 + Suit | 3.058 | 32.7055 | 28 |
| 12 + Suit | 3.634 | 27.5151 | 20 |
| 13 + Suit | 3.872 | 25.8253 | 20 |
| 14 + Suit | 3.613 | 27.6810 | 20 |
| 15 + Suit | 2.825 | 35.4011 | 28 |
| 16 + Suit | 1.702 | 58.7443 | 48 |

*Can be 150 to 1 for "Bonus Odds"

When played as a casino game, players may make monetary wagers by placing chips (or cash) representing their bet(s) on designated areas of the playing field 10. Payouts for winning wagers depend on the odds of each bet. In a home version of the game, players may, for example, "bet" varied amounts and be awarded or deducted "points" according to the amount wagered and payout odds. In a casino setting the game would have a dealer who does not make bets, but who deals the cards and pays out on winning bets. In a home version, the dealer could also be a player and make bets. Additionally, the role of dealer could rotate among the players.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. A casino-style game for one or more players, comprising:

means for determining an integer between five and seventeen, the means including a standard, shuffled four-suited deck of playing cards and the integer being the total number of cards required to be sequentially exposed until five cards of one suit have been exposed;

at least one bet-indicating marker for each player; and a playing field having indicia that indicates thirteen designated areas, the designated areas including integer spaces designated five through seventeen on which at least one bet-indicating marker is placed by a player and the playing field including card spaces designated for each suit of the playing cards, wherein the thirteen designated areas are arranged in a grid of at least two columns and at least two rows such that each designated area is contiguous with at least two other designated areas and on which each of the at least one bet-indicating marker is placed by a player on one of the designated areas or bridging more than one designated area.

2. The game of claim 1, further comprising designated outside bet spaces on which a bet-indicating marker may be placed that include two color spaces, each associated with either red or black, wherein the color of the last card to be exposed determines a winner for a bet made on a color space.

3. The game of claim 1, further comprising designated outside bet spaces on which a bet-indicating marker may be placed that include four suit spaces, each associated with one of hearts, diamonds, spades, or clubs, wherein the suit of the last card to be exposed determines a winner for a bet made on a suit space.

4. The game of claim 1, further comprising designated outside bet spaces on which a bet-indicating marker may be placed that include two color spaces, each associated with either red or black, and include four suit spaces, each associated with one of hearts, diamonds, spades, or clubs, wherein the color and suit of the last card to be exposed determines a winner for a bet made on the color spaces and the suit spaces.

5. The game of claim 4, further comprising one of the integer spaces being designated a house number which, if determined, causes all bets on outside bet spaces to lose.

6. The game of claim 1, further comprising indicia associated with at least one of the integer spaces designating an enhanced bet, the indicia including designations associated with hearts, diamonds, spades, or clubs, wherein a bet made on both determined integer and the suit of the last card to be exposed provides an enhanced payout.

7. The game of claim 1, wherein the card spaces comprise spaces for five cards of each suite, the fifth space for each suit being separately demarcated.

* * * * *